US009982367B2

(12) United States Patent
Goretzki et al.

(10) Patent No.: US 9,982,367 B2
(45) Date of Patent: May 29, 2018

(54) METHOD AND APPARATUS FOR MAKING A NONWOVEN FABRIC FROM THERMOPLASTIC FILAMENTS

(71) Applicant: Reifenhaeuser GmbH & Co.KG Maschinenfabrik, Troisdorf (DE)

(72) Inventors: Felix Goretzki, Ense Bremen (DE); Emin Ozgoeren, Troisdorf (DE); Sebastian Sommer, Troisdorf (DE); Detlef Frey, Niederkassel (DE); Alexander Klein, Troisdorf (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 247 days.

(21) Appl. No.: 15/138,321

(22) Filed: Apr. 26, 2016

(65) Prior Publication Data

US 2016/0312384 A1 Oct. 27, 2016

(30) Foreign Application Priority Data

Apr. 27, 2015 (EP) ..... 15165268

(51) Int. Cl.
*D01D 5/098* (2006.01)
*D04H 3/007* (2012.01)
(Continued)

(52) U.S. Cl.
CPC ..... *D01D 5/0985* (2013.01); *D01D 5/092* (2013.01); *D04H 3/007* (2013.01); *D04H 3/02* (2013.01);
(Continued)

(58) Field of Classification Search
CPC ..... D01D 5/0985; D01D 5/092; D04H 3/03; D04H 3/02; D04H 3/16; D04H 3/007; D10B 2321/022
See application file for complete search history.

(56) References Cited

U.S. PATENT DOCUMENTS 5,766,646 A 6/1998 Geus et al.
5,820,888 A 10/1998 Geus et al.
(Continued)

FOREIGN PATENT DOCUMENTS

DE 102008051836 A1 4/2010
GB 1271844 A * 4/1972 ..... D01D 5/0985

*Primary Examiner* — Matthew J Daniels
*Assistant Examiner* — Leith S Shafi
(74) *Attorney, Agent, or Firm* — Andrew Wilford

(57) ABSTRACT

A method of making a spun-bond nonwoven fabric of thermoplastic filaments has the steps of first spinning the thermoplastic filaments, then cooling the spun filaments, and then conducting the cooled and spun filaments in a travel direction through a stretcher with primary air such that the primary air exits a downstream end of the stretcher with the filaments at a predetermined primary air volume/flow $V_P$. The filaments and substantially all of the primary air are passed together as a flow from the downstream end of the stretcher into a diffuser. Secondary air is introduced into the flow at a secondary air volume/flow $V_S$ such that a ratio $V_P/V_S$ of the primary rate $V_P$ to the secondary rate is equal to at least 4.5 and the primary and secondary air flow with the filaments in the travel direction through the diffuser.

16 Claims, 4 Drawing Sheets

(51) Int. Cl.

| | |
|---|---|
| ***D04H 3/16*** | (2006.01) |
| ***D04H 3/02*** | (2006.01) |
| ***D04H 3/03*** | (2012.01) |
| ***D01D 5/092*** | (2006.01) |

(52) U.S. Cl.
CPC ..... *D04H 3/03* (2013.01); *D04H 3/16* (2013.01); *D10B 2321/022* (2013.01)

(56) References Cited

U.S. PATENT DOCUMENTS

| | | | | |
|---|---|---|---|---|
| 6,689,703 | B1 * | 2/2004 | Kobayashi | D01D 5/22 428/369 |
| 7,780,904 | B2 * | 8/2010 | Hisada | D01D 5/088 264/103 |
| 2005/0217226 | A1 * | 10/2005 | Sundet | B01D 39/1623 55/521 |
| 2016/0002825 | A1 | 1/2016 | Cinquemani et al. | |

* cited by examiner

METHOD AND APPARATUS FOR MAKING A NONWOVEN FABRIC FROM THERMOPLASTIC FILAMENTS

FIELD OF THE INVENTION

The invention relates to a method of making a spun-bonded fabric from filaments, in particular, from filaments of thermoplastic synthetic material, where the filaments are spun using at least one spinner, are subsequently cooled and then guided with primary air through a stretcher. Moreover, the invention relates to an apparatus for making a spun-bonded fabric and a spunbond made from filaments or continuous filaments.

BACKGROUND OF THE INVENTION

A method and apparatus of the above-described type are known in practice in various embodiments. In the method, it is also known that the filaments stretched with the help of the stretcher are guided through at least one diffuser to a deposition station and there deposited on a foraminous deposition belt. The spunbond fabric produced in this way is prebonded or bonded with the help of a calander with several methods.

The spunbond fabrics produced can be characterized on the one hand by their durability or tensile strength in the machine direction (MD) and on the other hand by their durability and tensile strength in a transverse direction (CD). The machine direction (MD) is equivalent to the travel direction of the deposited spunbond fabric. The strengths mentioned are also referred to as longitudinal and transverse strength. In the known methods, spun-bonded fabrics are usually made where which the ratio of the longitudinal to transverse strength lies in the range of 1.5 to 2. This means that the longitudinal strength or the strength in the machine direction (MD) is higher or significantly higher than the strength in the transverse direction (CD). In spun-bonded fabrics with higher weight per unit area, even lower values of the above-mentioned ratio can be achieved. It would now be desirable to improve the isotropy of the spun-bonded fabrics in relation to their longitudinal strength and transverse strength.

OBJECT OF THE INVENTION

Accordingly, the object of invention is to provide a method of the above-described type with which the isotropic or approximately isotropic strength of the spun-bonded fabrics can be achieved longitudinally and transversely.

Another object of the invention is to provide a suitable apparatus for this. In addition, the invention deals with the technical problem of providing a spun-bonded fabric with isotropic strength related to longitudinal and transverse directions.

Furthermore, in addition to the isotropic or approximate isotropic strength properties, homogeneous deposition of the filaments should also be ensured.

SUMMARY OF THE INVENTION

A method of making a spun-bond nonwoven fabric of thermoplastic filaments has according to the invention the steps of first spinning the thermoplastic filaments, then cooling the spun filaments, and then conducting the cooled and spun filaments in a travel direction through a stretcher with primary air such that the primary air exits a downstream end of the stretcher with the filaments at a predetermined primary air volume/flow $V_P$. The filaments and substantially all of the primary air are passed together as a flow from the downstream end of the stretcher into a diffuser. Secondary air is introduced into the flow at a secondary air volume/flow $V_S$ such that a ratio $V_P/V_S$ of the primary rate $V_P$ to the secondary rate is equal to at least 4.5 and the primary and secondary air flow with the filaments in the travel direction through the diffuser preferably more than 5 and very preferably more than 5.5. In line with particularly preferred embodiments of the invention, the ratio $V_P/V_S$ may also be more than 6 or more than 6.5. Finally the filaments are deposited downstream of a downstream end of the diffuser onto a deposition surface.

It is within the scope of the invention that the corresponding filaments are continuous filaments produced using a spunbond method. For cooling the spun filaments, a cooler is required with at least one cooling chamber in which the filaments are exposed to cooling air. It is within the scope of the invention that the stretcher and the diffuser extend transversely to the machine direction over the production width or over the width of the spun-bonded fabric to be produced. Within the scope of the invention, primary air means the process air that is guided from the stretcher or the stretching chamber into the diffuser through the stretcher or through a stretching chamber into the diffuser. Hereinafter, the primary air will also be referred to as process air. According to the recommended embodiment of the invention, the volume/flow $V_S$ of the secondary air entering the diffuser between the diffuser and the stretcher is less than 20% of the volume/flow $V_P$ of primary air flow and process air flow emerging from the stretcher.

It is within the scope of the invention that the filaments are conducted into a cooler with at least one cooling chamber for cooling and are then conducted into the stretcher, and that the assembly of cooler and stretcher is a closed system in which, exceot for the supply of the cooling air or process air, no other air is allowed to enter. It lies within the scope of the invention that the stretching chamber of the stretcher connects to the cooler in such a way that, between the cooler and stretcher, no other air can enter the system. The above-described closed system is particularly preferred in the invention and has proven itself here. In principle, the method of this invention could also be used for an open system.

A recommended embodiment of the invention is characterized in that a first air inlet is provided between the stretcher or the stretching chamber and the diffuser, as well as a second air inlet downstream in the machine direction of the first air inlet. It is possible that the height or the vertical height of the two air inlets is different from each other, so that the one air inlet has a different spacing from the deposition surface than the other air inlet. Preferably, the volume/flow $V_{S1}$ of the secondary air introduced through the first air inlet is different from the volume/flow $V_{S2}$ of the secondary air introduced through the second air inlet. The two air inlets are slots that extend transversely to the machine direction over the production width or over the width of the produced spun-bonded fabric, according to the preferred embodiment. The above-described asymmetry of the volume/flows $V_{S1}$ and $V_{S2}$ has proven effective in the inventive method.

The volume/flows $V_{S1}$ and $V_{S2}$ of the secondary air combine to form the entire secondary air volume/flow $V_S$ ($V_S=V_{S1}+V_{S2}$). The opening width of the air inlet or openings may be consistent across the width of the apparatus or across the width of the bonded strands to be produced. Depending on the preferred embodiment, the gap width of the air inlet or openings may vary and thus the local secondary air flow across the width of the apparatus may differ. It is of particular importance that, in the context of the invention, the opening width in the edge region is different from the opening width in the middle region and that the opening width of the air inlet or openings in the edge region is/are lower than in the middle region. Therefore, subsequently when the opening width is addressed, the middle region is meant and preferably, when specifying the secondary air flows, the average secondary air flow is meant in each case. Appropriately, the gap width of the first air inlet and the second air inlet in each case is 0.8 to 20 mm, preferably 1 to 15 mm, and even better 1 to 10 mm. In accordance with a recommended embodiment, this gap width is 0.8 to 4 mm, preferably 1 to 3 mm.

It is therefore within the scope of the invention that a lower secondary air quantity flows through the one air inlet between the stretcher and diffuser than through the other air inlet between the stretcher and diffuser. Preferably, a secondary air volume/flow is at least 10% lower than the other secondary air volume flow, rate preferably at least 20% and very preferably at least 25%. It is therefore appropriate for a secondary air volume/flow to be 90% lower at most, and preferably no more than 80% lower than the other secondary air volume/flow.

It is within the scope of the invention that the gap width of the two arranged air inlets between the stretcher and diffuser are independently adjustable. Appropriately, the gap width of an air inlet is set smaller than the gap width of the other air inlet.

The embodiment with two air inlets and thus two secondary air volume/flows enable normal hygiene applications with spun-bonded fabrics, which offers the possibility for obtaining relatively light weights per unit area and a uniform spun-bonded structure at a ratio of tensile strength of the spun-bonded fabric in the machine direction (MD) to tensile strength of the spun-bonded fabric in the transverse direction (CD) above 1.5. This embodiment is thus extremely versatile. An embodiment with only one air inlet is suitable for the production of spun-bonded fabrics with basis weights above about 40 g/m$^2$ as well as with ratios of the tensile strength at around 1. Here flow-rate ratios $V_P/V_S$ above 4.5 are also relevant.

A highly recommended embodiment of the invention is characterized in that one or at least one air chamber is connected upstream to an air inlet between the stretcher and diffuser, this air chamber has at least one air inlet, advantageously 1 to 6 air inlets, and the secondary air supply is set or metered through the single air inlet at the very least or through the multiple air inlets of the air chamber. Appropriately, in all cases at least one air chamber should be connected to each of the two air inlets between the stretcher and diffuser, preferably 1 to 6 air inlets. It is therefore recommended that the secondary air supply is set or controlled by the air inlets of the air chambers. The implementation of this embodiment is based on the knowledge that the air inlets between the stretcher and diffuser can be easily blocked by impurities. In such a case, the secondary air supply throughout the production range will no longer be constant and this will negatively affect the depositing process of the filaments. The upstream connection of air chambers allows for an accurate and reproducible supply of secondary air. In order to purify the supplied air, filters can easily be fitted to the air chambers or to the air inlets. These filters can be easily replaced or cleaned. By contrast, cleaning the air inlet for the secondary air is more problematic and the same is true for the attachment of filters across the entire apparatus. The few air inlets of the air chambers allow for very precise adjustment of the secondary air supplied. It should be noted that small or narrow air inlets between the stretcher and diffuser cannot be set very accurately compared to larger air inlets. Using the upstream air chambers, relatively large easily adjustable air inlets can be realized and the secondary air supply can instead be set to be metered to the air inlet ports of the air chambers. Setting or metering the inflowing secondary air can be achieved reliably by using valves and similar control elements for example. In accordance with one embodiment of the inventive method, subatmospheric pressure can be maintained in the air chambers, so that increased pressure caused by an upstream filter can be compensated.

Appropriately, the subatmospheric pressure in the air chambers is measured and preferably controlled or kept constant using the upstream valves or similar control elements. In this way, the contamination of filters and the associated reduction of volume/flows can be avoided. The air inlets upstream of the air chambers have proven themselves particularly well in the framework of the invention.

A recommended embodiment of the inventive method is characterized in that the stretcher only has one diffuser with diverging diffuser walls downstream of the deposition surface. Divergence here specifically means that the width of the upstream end of the diffuser in the machine direction is smaller than the width of the downstream end of the diffuser in the machine direction. It is within the scope of the invention that the diffuser or its diffuser walls extends/extend over the entire apparatus or production range. In accordance with a preferred embodiment of the invention, the opening angle $\alpha$ of the diffuser is in the range between 2° and 4.5°, appropriately in the range of 2.5° to 4°. Basically, the opening angle $\alpha$ can also be adjusted to be greater than 4° or greater than 4.5°. The opening angle $\alpha$ of the diffuser is measured between a median plane M using the height of the lower ends of the stretching chamber of the stretcher and the lower ends of the diffuser walls of the diffuser. This is explained below in greater detail.

The width B of the outlet of the diffuser is preferably in machine direction at least at 250%, preferably at 300% of the width b of the outlet of the stretching chamber of the stretcher. It is recommended that the width B is 250% to 450%, preferably 300% to 400% of the width b. The width B or b in this case is measured as the spacing between the lower ends of the stretching chamber walls or as a spacing between the lower ends of the diffuser walls. Therefore, with beveled or rounded lower ends of the diffuser walls, the spacing between the lowest points of the diffuser walls is meant. If the edge angle of the edged diffuser walls is about 90°, the spacing between the edge lines is specifically meant. It is within the scope of the invention that the area of the outlet opening of the diffuser is at least 250%, preferably at least 300% of the area of the outlet opening of the stretching chamber of the stretcher. Here it is assumed that the lower ends of the stretching chamber and the diffuser walls over the breadth of the apparatus or production range have the same spacing to the deposition surface and the surface thus is calculated based on the spacing between the lower ends of the stretching chamber or from the spacing between the lower ends of the diffuser walls and the length of the stretching chamber and the diffuser.

A preferred embodiment of the method in accordance with the inventive method is characterized in that the diverging diffuser walls or the inner walls of the diffuser are asymmetrically adjustable in terms of a median plane M running through the apparatus. Preferably, the closer to the median plane M the diffuser wall or diffuser inner wall of the side of the diffuser is arranged, the lower the secondary air flow into the diffuser is. In the case of two air inlets, the diffuser wall positioned closer to the median plane M or the diffuser inner wall necessarily assigned to the air inlet whose gap width is smaller than the gap width of the other air inlet or is set smaller. Median plane M specifically means a line passing through the center of the stretching chamber median plane M, seen in the machine direction. The fact that a diffuser wall is associated with an air inlet, within the scope of the invention, means that the diffuser wall seen in the machine direction is assigned to first air inlet viewed in the machine direction and the second diffuser wall seen in the machine direction is assigned to the second air inlet. For example, if a lower secondary air volume/flow passes through the second air inlet than through the first air inlet, the second diffuser wall will be positioned closer to the median plane M than the first diffuser wall. If, in accordance with an embodiment of the invention, only one air inlet is present, the diffuser wall that is further away from the median plane M will have this single air inlet assigned to it. Appropriately, the difference between the spacings of the diffuser walls or diffuser inner walls to the median plane M is at least 5% or at least 5 mm in a minimum of one horizontal height position.

Preferably, the deposition surface for the filaments or the spun-bonded fabric is air-permeable and an air-permeable deposition screen is used as a deposition surface in accordance with the recommended embodiment. It is within the scope of the invention that from the underside of the deposition surface facing the filaments suction air is conducted through the deposition surface. This suction air is used on the one hand for removing the process air and on the other hand for fixing the unbonded strands on the deposition surface or on the foraminous deposition belt.

For this purpose, at least one exhaust fan is required. In the inventive method, a mixture of process air or primary air and secondary air or atmospheric air is usually drawn through the deposition surface or through the foraminous deposition belt. A highly preferred embodiment of the inventive method is characterized in that the suction air velocity $V_L$ or the average suction air velocity $V_L$ of the suction air below the outlet opening of the diffuser and directly above the deposition surface or directly above the foraminous deposition belt is 5 to 25 m/sec, preferably from 5 to 20 m/sec and very preferably 10 to 20 m/sec. To determine the average suction air velocity $V_L$ of the suction air volume/flow is calculated using the area below the outlet opening B.

It is within the scope of the invention that the spunbond strands of the deposited filaments are prebonded or bonded after deposition. The prebonding or bonding occurs in line with recommendations using at least one calender. Preferably, the calender has two calender rollers, of which at least one is heated. It is recommended that the calender has a relief surface between 5 and 22%, preferably between 15 and 22%. Appropriately, the character density of the calender or at least one calender roller of the calender comprises 35 to 60 Fig./cm$^2$.

To attain the object, the invention also provides an apparatus for making a spun-bonded fabric of filaments, in particular of filaments of thermoplastic synthetic material, with a spinner for spinning the filaments, with a cooler for cooling the spun filaments, and with a cooler downstream of the stretcher, with a stretching chamber for drawing the filaments, the filaments emerging together with a primary air volume/flow $V_P$ from the stretching chamber of the stretcher, the stretcher or the stretching chamber being connected downstream to at least one diffuser and at least one air inlet being assigned for secondary air between the stretching chamber and the diffuser, and the primary air volume/flow $V_P$ is greater or significantly greater than the air flowing in through the at least one air inlet for secondary air volume/flow $V_S$ and the width B of the outlet opening of the diffuser is at least 250%, and preferably is at least 300% of the width b of the outlet opening of the stretching chamber. That the primary air volume/flow $V_P$ is significantly larger than the secondary air volume/flow $V_S$ specifically means that, within the scope of the invention, the ratio or the secondary air speed $V_P/V_S$ is more than 4.5, preferably more than 5 and very preferably more than 5.5.

It is recommended that the width B of the outlet opening of the diffuser be 50 to 170 mm, preferably 60 to 150 mm and expediently 70 to 140 mm. The width B of the outlet opening of the diffuser from 80 to 100 mm is the most preferable. The width B of the outlet opening was already defined above. It is the spacing between the lower ends of the diffuser walls of the diffuser. In accordance with a particularly trusted embodiment of the invention, the spacing A or the vertical spacing between the diffuser and deposition surface amounts to 30 to 300 mm, preferably 50 to 250 mm and very preferably 70 to 200 mm. The spacing a is measured from the lowermost end of the diffuser or the diffuser walls to the surface of the deposition surface or the foraminous deposition belt preferably used.

An object of the invention also includes a spun-bonded fabric produced especially in accordance with the method described above or with the apparatus described above. It appropriately concerns a calendered spun-bonded fabric. In this inventive spun-bonded fabric or calendered spun-bonded fabric the recommended ratio of the tensile strength of the spun-bonded fabric in the machine direction (MD) to the tensile strength of the spun-bonded fabric in the transverse direction (CD) is less than 1.3, preferably less than 1.2, and most preferably, this ratio lies between 0.8 and 1.2. The tensile strengths are determined specifically based on the measurement of the maximum tensile force. The measurement of the tensile strength is carried out appropriately in accordance with DIN EN 29073-3 in N/5 cm.—The inventive spun-bonded fabrics have in particular a variation coefficient of the strength of less than 15%, preferably of less than 10%. The variation coefficient results from the quotient of standard deviation and mean value and is determined separately respectively for longitudinal and transverse directions, and is the average of these two values. Preferably six samples are thereby measured per direction. The spun-bonded fabrics inventively produced are characterized by a particularly homogeneous deposition. In particular, the variation coefficient of the basis weight is smaller than 15%, preferably less than 10%. The variation coefficient relates appropriately to a measuring surface with a diameter of 25 mm, with the use of 25 equidistantly located test areas.

As filaments for the inventively produced spun-bonded fabric, within the context of the invention, both monocomponent filaments and bicomponent filaments or multicomponent filaments are used. In the bicomponent filaments or multicomponent filaments, a core-shell configuration is most highly recommended. In accordance with a particularly preferred embodiment of the invention, the spun filaments for the spun-bonded fabric are made from at least one polyolefin, preferably of polypropylene or polyethylene. However, in essence other raw materials such as polyamide or polyethylene terephthalate (PET) and the like can also be used. The deposited spunbond strands can be prebonded or bonded in ways other than with a calender. In essence, the spun-bonded fabric can be further modified in subsequent processes, including transversely stretched such as in a tenter frame. The above characteristics—especially the measured strengths or tensile strengths—and the resulting MD/CD ratio reflects the state of the spun-bonded fabric after the first prebonding or bonding, even if the filament orientation is not subsequently affected in a targeted way—for example, by longitudinal or transverse stretching.

The invention is based on the discovery that the spun-bonded fabrics can be produced with the inventive method or apparatus with relatively high strength and tensile strength to transverse direction (CD direction). In particular, the strength can be adjusted according to the invention so that no major differences between the strengths and tensile strengths in the machine direction on the one hand and the transverse direction on the other hand can be observed. Consequently, a tensile strength MD/CD of 0.8 to 1.2 and preferably of 0.9 to 1.1 can be easily adjusted. In this case, this setting is simple, functionally reliable and is reproducible.

Furthermore, with the inventive method and apparatus, a very homogeneous and uniform deposition of the filaments can also be achieved. This means that optimum coverage or opacity of the spun-bonded fabric is achieved. Defects or holes in the filament deposition can be easily avoided. In summary, it must be noted that with the inventive method and apparatus, an optimum compromise between a balanced strength ratio MD/CD on the one hand and an extremely homogeneous deposition on the other hand can be achieved in a simple and functionally reliable way. In spun-bonded fabrics with basis weights below 40 g/m$^2$—which will primarily be used for hygienic applications—good coverage or opacity of the spun-bonded fabric is especially important. The achievement of these advantageous properties in spun-bonded fabrics known hitherto usually come at the expense of transverse strength (CD strength). With this inventive method or apparatus, both good coverage or opacity as well as a sufficient transverse strength can be achieved for this light spun-bonded fabric. In spun-bonded fabrics with basis weights above 40 g/m$^2$ high transverse strengths are essential.

The realization of these high transverse strengths was associated with previously known methods came at the detriment of the homogeneity of the filament deposition. Especially with larger opening angles of the diffuser, unacceptable inhomogeneous filament deposition occurs. With these inventive measures, both a high transverse strength (CD strength) as well as an acceptable homogeneous filament deposition can also be achieved for these heavier spun-bonded fabrics. It is important to note that the inventive measures can be achieved with relatively simple and inexpensive means.

BRIEF DESCRIPTION OF THE DRAWING

The invention will now be further illustrated using a drawing showing a single embodiment: Shown in a schematic representation.

SPECIFIC DESCRIPTION OF THE INVENTION

Figure 1:
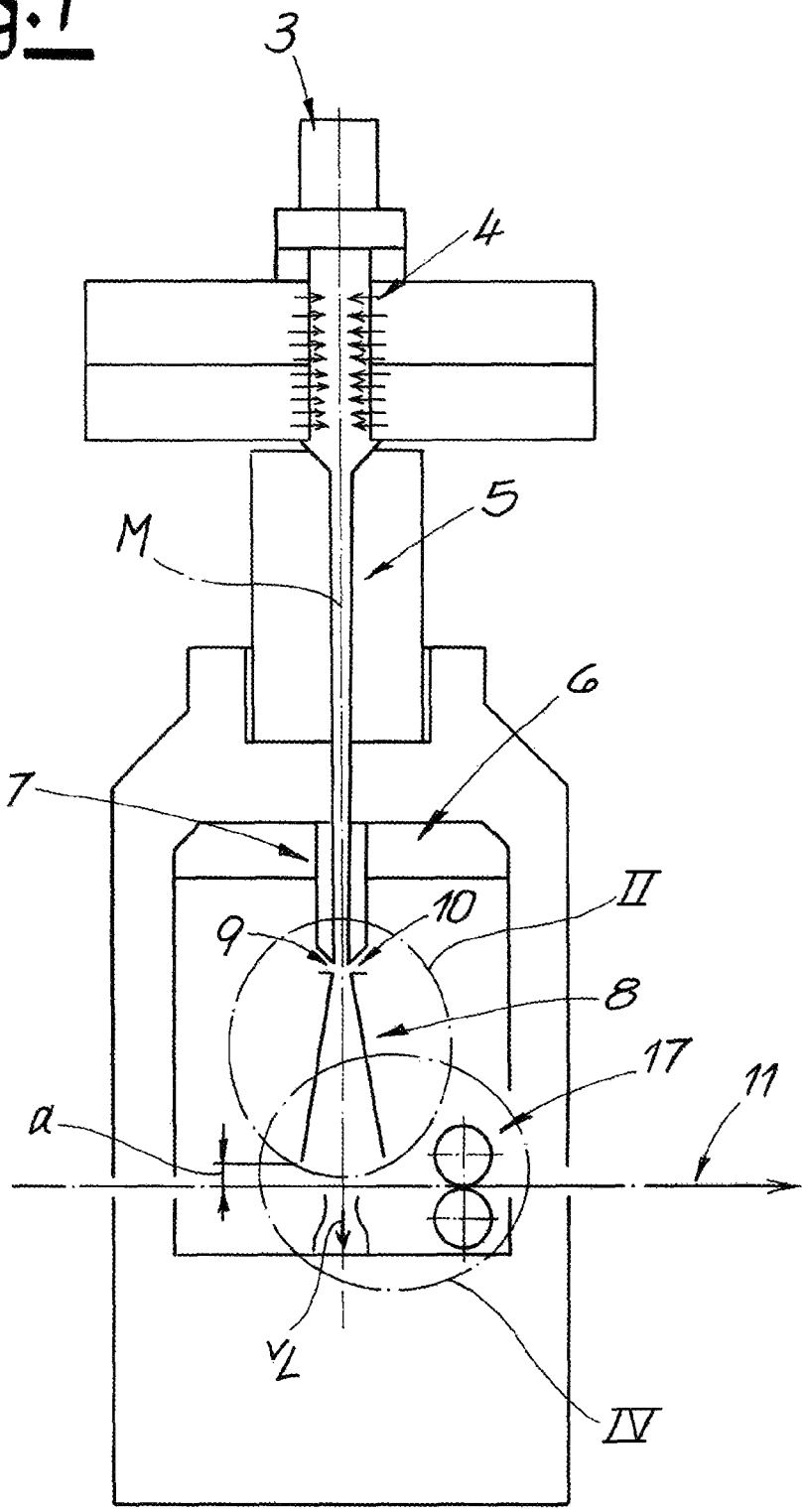
FIG. 1 is a vertical section through an inventive apparatus for performing the method in accordance with the invention using two air inlets.
Figure 2:
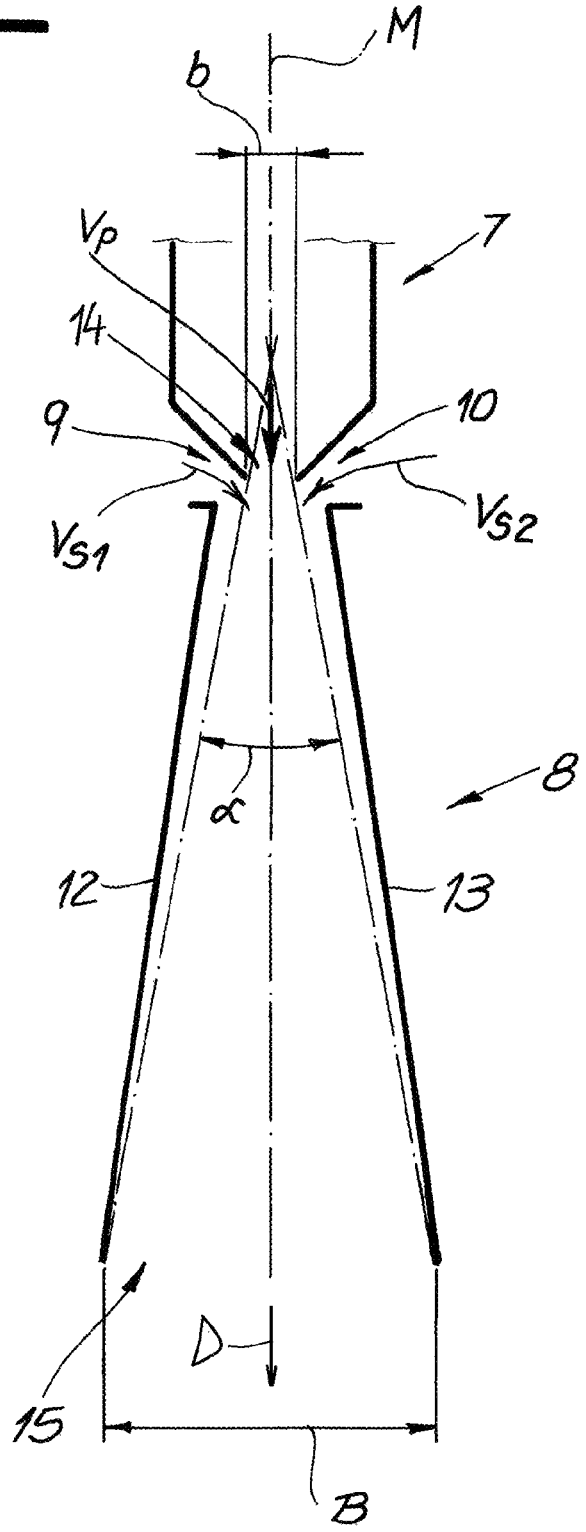
FIG. 2 is an enlarged detail II from FIG. 1.

In the figures, an inventive apparatus for carrying out the method in accordance with the invention for the manufacture of a spun-bonded fabric 1 made of filaments 2, in particular showing filaments 2 made of thermoplastic material. In the context of the inventive method, the filaments 2 are initially spun by a spinner 3 as seen in FIG. 1. To cool them, the filaments are then conducted through a cooler 4. An intermediate duct 5 preferably connected to the cooler 4 in the embodiment connects the cooler 4 with a stretcher 6 or with a stretching chamber 7 of the stretcher 6. The stretcher 6 is connected to a diffuser 8 downstream in a filament travel direction D (FIG. 2). According to the preferred embodiment, the assembly of the cooler 4 and the stretcher 6 or the assembly of the cooler 4, the intermediate duct 5 and the stretcher 6 is a closed system. Except for the supply of cooling air into the cooler 4 no additional air supply is fed into this assembly.

The air conducted through the stretcher or through the stretching chamber 7 air is referred to herein as primary air or process air.

It is within the scope of the invention that, with respect to the machine direction (MD), two oppositely facing air inlets 9 and 10 are situated between the stretcher 6 or between the stretching chamber 7 and the diffuser 8. Due to these air inlets 9 and 10, a secondary air volume/flow $V_S$ is introduced into the diffuser 8. Thereby, a first secondary air volume stream $V_{S1}$ flows through the first air inlet 9, while downstream in the machine direction of the first air inlet 9, a secondary air volume/flow $V_{S2}$ flows through the second air inlet 10. It is within the scope of the invention that the stretching chamber 7, the air inlets 9 and 10 and the diffuser 8 extend in the transverse machine direction across the apparatus width and production range. In accordance with the invention, the method is carried out in a way that the primary air volume/flow $V_P$ emerging from the stretching chamber 7 is significantly greater than the entire secondary air volume/flow $V_S$ ($V_S=V_{S1}+V_{S2}$). According to the invention, this ratio of primary air volume/flow $V_P$ to the secondary air volume/flow $V_S$ or the flow-rate ratio $V_P/V_S$ is more than 4.5, preferably more than 5 and very preferably more than 5.5. According to an especially recommended embodiment of the invention, the flow-rate ratio exceeds 6 and according to one embodiment is even more than 6.5.

It is also within the scope of the invention that the secondary air volume/flow $V_{S1}$ introduced transversely to the direction D through the first air inlet 9 is different from the secondary air volume/flow $V_{S2}$ introduced through the second air inlet 10.

The asymmetry of the secondary air flow rates $V_{S1}$ and $V_{S2}$ has particularly proven itself in the invention. The opening width or gap width of the air inlets 9 and 10 lie between 5 and 15 mm. A particularly recommended embodiment of the invention is characterized in that the secondary air volume/flow is at least 10% lower than the other secondary air volume/flow preferably at least 20% and very preferably at least 25% and advantageously at most 90%, with the best proven capability at most 80% lower than the other secondary air volume/flow. It is thus appropriate that a lower amount of secondary air flows through one air inlet 9 and 10 than through the other opening 9 and 10. Appropriately, the opening width of the two air inlets 9 and 10 arranged between the stretching chamber 7 and diffuser 8 is independently adjustable and, in line with the recommended embodiment of the invention, the opening width of one air inlet 9 and 10 is set smaller than the opening width of the other air inlet 9 and 10.

An unillustrated embodiment of the invention is characterized in that between the stretching chamber 7 and diffuser 8 the air inlets 9 and 10 each have an upstream air chamber, and the air chamber advantageously has a plurality of air inlets, for example six on the unit width distributed air inlets. The secondary air supply through the air inlets 9 and 10 can be controlled with or without feedback or dosed by these air inlets. The secondary air flow rates $V_{S1}$ and $V_{S2}$ are then controlled at the air inlets, for example, with the aid of flaps, slides, blowers and the like.

According to an advantageous embodiment a filter may be present in the air chambers or at the air inlets for filtering the incoming secondary air. This effectively avoids clogging the air inlet 9 and 10.

According to a particularly recommended embodiment, only a diffuser 8 for the filaments 2 with two walls 12 and 13 diverging toward a deposition surface 11 is provided downstream of the stretcher 6. It is advisable that the opening angle α of the diffuser 8 is greater than 2° and advantageously greater than 2.5°. In a particularly preferred embodiment, the opening angle α of the diffuser 8 is in the range between 2.5° and 4°. The measurement of the opening angle α is illustrated in FIG. 2. In this case, the opening angle α is—as illustrated in FIG. 2—is measured at the slot outlet 14 of the stretching chamber 7 and the slot outlet 15 of the diffuser 8. Moreover, preferably, the width B of the outlet opening 15 of the diffuser 8 is at least 250%, preferably at least 300% of the width b of the outlet opening 14 of the stretching chamber 7.

Figure 3A:
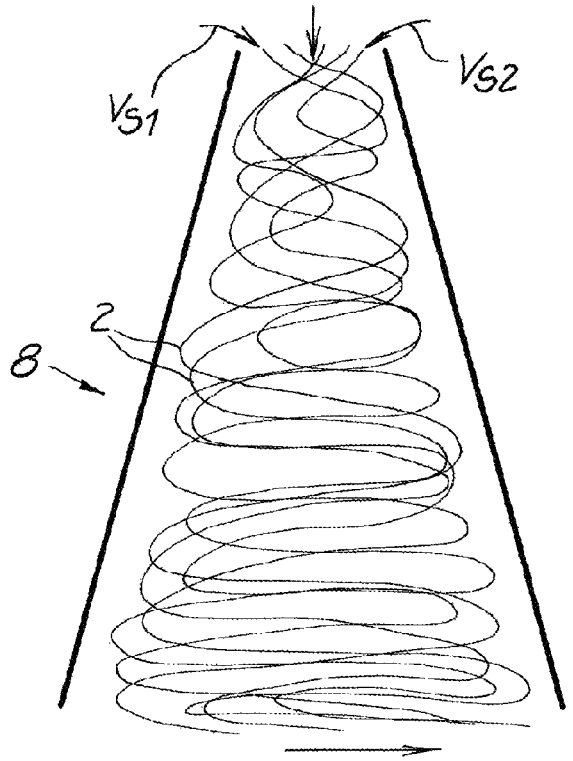
Fig.3A Prior Art
FIG. 3A is a is an enlarged view of a detail of FIG. 2 of a prior-art diffuser.
Figure 3B:
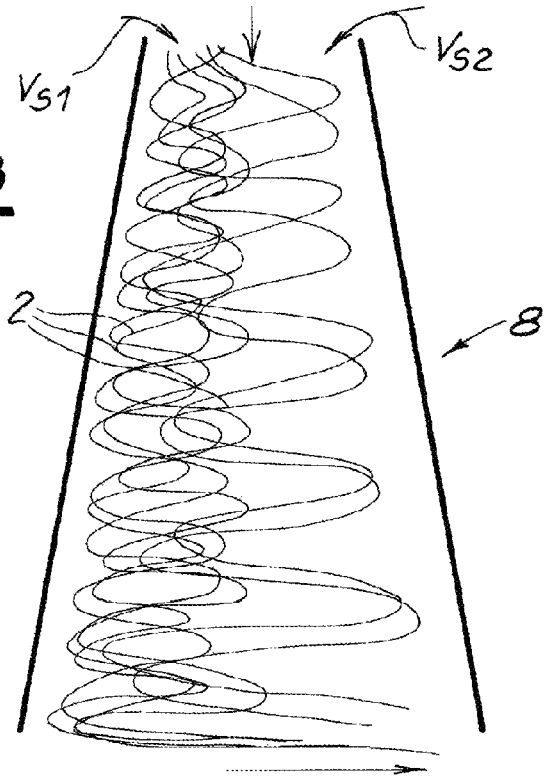
FIG. 3B is a view like FIG. 3A but showing the diffuser of this invention.

FIGS. 3A and 3B show a diffuser 8 as a sorter for the spunbond 1 forming filaments 2. In this case FIG. 3A shows desposition of the filaments 2 according to the prior art. Here, identify homogeneous filament density is seen over the cross section of the diffuser 8. In contrast, FIG. 3B shows the deposition of filaments 2 in accordance with the method of this invention. In the method, the secondary air flow rates $V_{S1}$ and $V_{S2}$ entering through the first air inlet 9 and through the second air inlet 10 are different from each other ($V_{S1} \neq V_{S2}$).

In the embodiment of FIG. 3B the secondary air flow rate $V_{S2}$ is greater than the secondary air flow rate $V_{S1}$. This means that the filaments 2 on the left side of the diffuser have a high filament density and homogeneous deposition. This homogeneous and narrow deposition results in a good opacity of the spun-bonded fabric. On the right side of the diffuser 8, however, a low filament density is observed and the filaments 2 are stored in this area at a wide spacing. This leads to advantageous high transverse strength. In that regard, as explained by the inventive procedure, one achieves a good compromise between high transverse strength on the one hand and homogeneous filament deposition the other.

Figure 4:
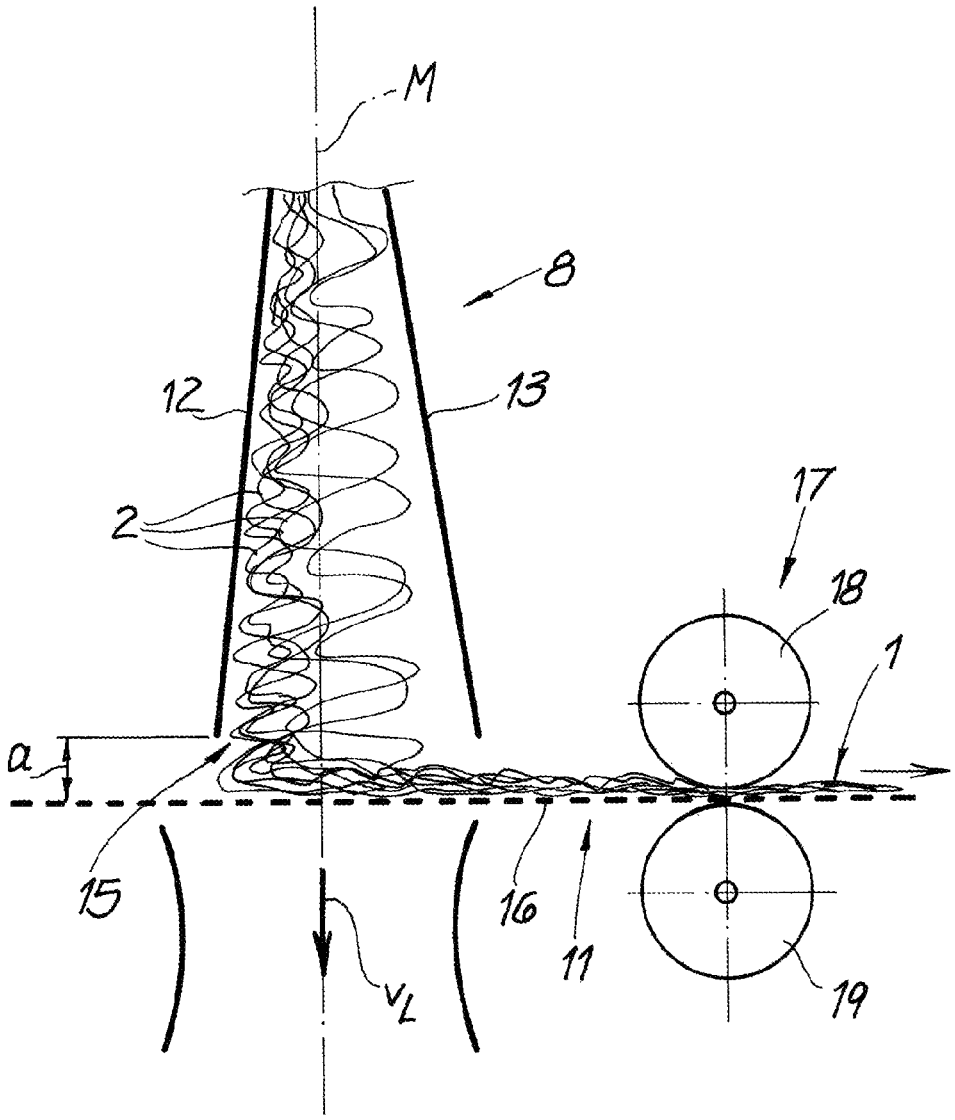
FIG. 4 shows an enlarged detail view as indicated at IV in FIG. 1.

According to a recommended embodiment (see in particular FIG. 4) the diverging diffuser walls 12 and 13 of the diffuser 8 are asymmetrical with respect to a plane passing through the apparatus center plane M adjustable. The center plane M preferably runs in the embodiment through the center of the stretching chamber 7 relative to the machine direction. Conveniently, and in the embodiment (FIG. 4), the diffuser wall 12 that is below the first air inlet 9 with the smaller inflowing secondary air volume/flow $V_{S1}$ is positioned closer to the center plane M. In the embodiment, the opening width of the first air inlet 9 is set to be smaller than the opening width of the second air inlet 10, so that the wall 12 closer to the center plane M is disposed below the narrow air inlet 9. It is within the scope of the invention that the difference of the spacing of the diffuser walls 12, 13 from the median plane M is at least at least 5% or at least 5 mm.

According to a very preferred embodiment, the deposition surface 11 of the inventive apparatus is designed as an air-permeable foraminous belt 16. One particular recommended embodiment of the invention is characterized in that the underside turned away from the spunbond 1 of the deposition surface 11 or the air-permeable deposition belt 16 is exposed to subatmospheric pressure to such air through the deposition surface 11 or the deposition screen belt 16. The suction air velocity $V_L$ or the average suction air velocity $V_L$ of the suction below the outlet opening 15 of the diffuser 8 and above the deposition surface 11 or above the deposition belt 16 is preferably 5 to 25 m/sec, preferably from 5 to 20 m/sec and very preferably 10 to 20 m/sec. Aspirating air and process air removes it from the system along with the still-molten spunbond at the deposition surface 11. The process air or primary air entrains secondary air and ambient air through the deposition screen 16 otherwise.

Suitably, the spun-bonded fabric formed the filaments 2 is preconsolidated after their deposition, in the exemplary embodiment by a calender 17 formed by two calender rolls 18 and 19. One of these calender rolls 18, 19 is advantageously heated. In the thus prepared calendered spunbond 1, the ratio of the tensile strength of the spun-bonded fabric 1 in the machine direction (MD) to the tensile strength of the spun-bonded fabric 1 in the transverse direction (CD) is less than 1.3. This ratio MD/CD is in a particularly preferred embodiment between 0.8 and 1.2. moreover, preferably, and in the exemplary embodiment, the width B of the outlet opening 15 of the diffuser 8 50 to 170 mm, preferably 60 to 150 mm, and very preferably 70 to 140 mm. Preferably the spacing a lies between the diffuser 8 and the foraminous conveyor 16 in the region between 50 and 150 mm. The spacing a is expediently measured from the lowest point of the diffuser 8 or from the lowest end of a diffuser wall 12, 13 and the surface of the belt 16.

The invention will be explained in more detail using embodiments as examples:

Spun-bonded fabrics have been produced in accordance with examples 1 to 4 in which all spun-bonded fabrics were made of continuous filaments of homopolypropylene by the company Borealis (HF420FB), with a melt flow index of 19 g/min. All spun-bonded fabrics were calendered and bonded with a calender of two calender rollers with an embossing area of 20% and a roller temperature of both rolls of 155° C. The weight per unit area of all spun-bonded fabrics was 65 g/m$^2$ and the filament fineness was 1.7 denier. Example 1 relates to the production of a spun-bonded fabric produced with the latest technology, with a secondary air speed $V_P/V_S$ of significantly less than 4.5, namely 3.0.

In contrast, examples 2 to 4 relate to spun-bonded fabric, which have been produced according to the inventive method, with a secondary air speed of $V_P/V_S$ greater than 4.5. In the table, beside the flow-rate ratio $V_P/V_S$, the entire secondary air volume/flow $V_S$ in 2/h is listed as well as the volume/flow $V_{S1}$ of the secondary air (in m$^3$/h) introduced through the first air inlet and the volume/flow $V_{S2}$ of the secondary air (in $^{m3}$/h) introduced through the second air inlet. In addition, the opening angle α of the diffuser and the average suction air velocity vL in m/sec the suction air below the outlet opening of the diffuser and above the deposition screen belt is listed below. Furthermore, the ratio of the tensile strength of the spun-bonded fabric in the machine direction (MD) to the tensile strength of the spun-bonded fabric in transverse direction (CD) is indicated as MD/CD and the variation coefficient CVT of the tensile strength and the variation coefficient cvFL of the basis weight.

This shows that inventive Example 3 has the best results. Here, an asymmetric secondary air supply volume and a secondary air speed $V_P/V_S$ greater than 4.5 was used. The opening angle α of the diffuser in this case is 3° and is thus in a highly preferred range of 2.5° to 4°. The volume/flows refer to the widths of the air inlets of 1.25 m.—In Example 4, only one air inlet is provided or is activated. This produces a less homogeneous spunbond deposition. Nonetheless, this spunbond deposition is suitable for various applications. A apparatus with only one air inlet offers the advantage of a simpler design and is less complex in terms of settings and maintenance.

| Example | $V_S$ | $V_{S1}$ | $V_{S2}$ | $V_P/V_S$ | α | $V_L$ | MD/CD | $CV_T$ | $CV_{FL}$ |
|---|---|---|---|---|---|---|---|---|---|
| 1 | 2400 | 1200 | 1200 | 3.0 | 3° | 10-20 | 1.26 | 4.75 | 8.9 |
| 2 | 1200 | 600 | 600 | 6.2 | 7.5° | 10-20 | 0.84 | 29.97 | 16.8 |
| 3 | 900 | 300 | 600 | 7.9 | 3° | 10-20 | 1.03 | 5.94 | 9.8 |
| 4 | 600 | 0 | 600 | 11.9 | 3° | 10-20 | 1.03 | 11.58 | 13.6 |

We claim:

1. A method of making a spun-bond nonwoven fabric of thermoplastic filaments, the method comprising the steps of:

spinning the thermoplastic filaments;

cooling the spun filaments;

conducting the cooled and spun filaments in a travel direction through a stretcher with primary air such that the primary air exits a downstream end of the stretcher with the filaments at a predetermined primary air volume/flow;

passing the filaments and substantially all of the primary air together as a flow from the downstream end of the stretcher into a diffuser;

introducing secondary air into the flow at a secondary air volume/flow such that a ratio of the primary flow rate to the secondary flow rate is equal to at least 4.5 and the primary and secondary air flow with the filaments in the travel direction through the diffuser; and depositing the filaments downstream of a downstream end of the diffuser onto a deposition surface.

2. The method defined in claim 1, wherein the ratio is more than 4.5.

3. The method defined in claim 1 wherein the ratio is more than 5.5.

4. The method defined in claim 1, wherein the filaments are cooled in a cooler connected to an upstream end of the stretcher such that the cooler and stretcher form a closed system into which, apart from a supply of cooling air provided, no additional air enters.

5. The method defined in claim 1, wherein the secondary air is introduced into the flow through a two separate inlets between the stretcher and the diffuser, the method comprising the step of:

introducing more of the secondary air into the flow through one of the inlets than through the other inlet.

6. The method defined in claim 5, wherein the secondary air is introduced into the flow through the other inlet at a volume/flow at least 10% lower than a volume/flow at which the secondary air is introduced into the flow through the one inlet.

7. The method defined in claim 5, wherein the volume/flow through the other inlet is at least 20% lower than the volume/flow through the one inlet.

8. The method defined in claim 5, wherein the volume/flow through the other inlet is at least 90% lower than the volume/flow through the one inlet.

9. The method defined in claim 5, wherein the flow cross sections of the inlets are adjustable for control of the respective volume/flows with the flow cross section of the other inlet smaller than the flow cross section of the one inlet.

10. The method defined in claim 1, wherein the secondary air is introduced into the flow through a single air inlet between the stretcher and the diffuser.

11. The method defined in claim 10, wherein a flow cross section of the inlet is adjustable.

12. The method defined in claim 5, wherein the diffuser has a pair of walls flanking the flow through it and diverging in the direction of flow at an opening angle of at least 2°.

13. The method defined in claim 12, wherein the diffuser has an upstream end of a predetermined flow cross section, the downstream end of the diffuser being of a flow cross section equal to at least 250% of the flow cross section of the diffuser upstream end.

14. The method defined in claim 12, wherein at least one of the diffuser walls is adjustable relative to a center plane parallel to the flow direction and is normally closer to the center plane on the side of the other inlet.

15. The method defined in claim 1, wherein the deposition surface is foraminous and horizontal, the travel direction is vertical, and the method further comprises the step of:

drawing air downward in the travel direction through the deposition surface at speed of 5 to 20 m/sec.

16. The method defined in claim 1, further comprising the step of:

consolidating the filaments after deposition on the surface with at least one calender.

* * * * *